US011834296B2

(12) United States Patent
Scherzer

(10) Patent No.: US 11,834,296 B2
(45) Date of Patent: Dec. 5, 2023

(54) MACHINE ROOM-LESS ELEVATOR CONSTRUCTION

(71) Applicant: Paul J. Scherzer, Manalapan, NJ (US)

(72) Inventor: Paul J. Scherzer, Manalapan, NJ (US)

( * ) Notice: Subject to any disclaimer, the term of this patent is extended or adjusted under 35 U.S.C. 154(b) by 0 days.

(21) Appl. No.: 17/128,014

(22) Filed: Dec. 19, 2020

(65) Prior Publication Data

US 2022/0194741 A1 Jun. 23, 2022

(51) Int. Cl.
*B66B 11/00* (2006.01)
*B66B 19/00* (2006.01)

(52) U.S. Cl.
CPC ..... *B66B 11/0045* (2013.01); *B66B 19/00* (2013.01); *B66B 19/002* (2013.01); *B66B 19/005* (2013.01)

(58) Field of Classification Search
CPC ... B66B 19/00; B66B 11/0045; B66B 19/002; B66B 19/005; B66B 7/023; B66B 7/024; B66B 7/025; B66B 7/026; B66B 7/027
See application file for complete search history.

(56) References Cited

U.S. PATENT DOCUMENTS 3,851,736 A * 12/1974 Westlake ..... B66B 19/002 52/30
5,000,292 A 3/1991 Chapelain
6,364,067 B1 * 4/2002 Glassey ..... B66B 19/00 187/408
6,446,763 B1 * 9/2002 Glassey ..... B66B 19/007 52/30
8,485,319 B2 7/2013 Peacock et al.
8,636,115 B2 1/2014 Peacock et al.
9,617,121 B2 * 4/2017 Bolme ..... B66B 19/002
10,246,305 B2 4/2019 Blaesi
2007/0256899 A1 * 11/2007 Fanielle ..... B66B 19/005 187/408
2009/0097952 A1 * 4/2009 Swaybill ..... B66B 19/005 414/800
2010/0133048 A1 * 6/2010 Barneman ..... B66B 19/00 187/414
2017/0313553 A1 * 11/2017 Püntener ..... B66B 19/002
2019/0106296 A1 * 4/2019 Barneman ..... B66B 19/00
(Continued)

FOREIGN PATENT DOCUMENTS

CN 109368446 2/2019
DE 202016103634 U1 * 12/2016 ..... B66B 19/005
EP 1245522 A1 * 10/2002 ..... B66B 19/005
(Continued)

OTHER PUBLICATIONS

Takeshi, Abe, Device and Method for Installing Guide Rail, Sep. 13, 1994, machine translation of JP H06255943 A (Year: 1994).*

*Primary Examiner* — Michael R Mansen
*Assistant Examiner* — Michelle M Lantrip
(74) *Attorney, Agent, or Firm* — Richard Malagiere, Esq.

(57) ABSTRACT

Disclosed embodiments provide techniques and apparatus for installing an elevator. A support frame is assembled at the top of an elevator passage. The permanent elevator motor is installed in the support frame. The permanent motor is then used to hoist materials as needed to build out the elevator system. Once built, the permanent motor that is already installed and has had hours of usage to verify its operation, is used for movement of the elevator car for the completed elevator system.

17 Claims, 19 Drawing Sheets

(56) References Cited

U.S. PATENT DOCUMENTS

2020/0283271 A1* 9/2020 Morse ..... B66B 19/005

FOREIGN PATENT DOCUMENTS

| | | | | | |
|---|---|---|---|---|---|
| EP | 2562123 | A1 * | 2/2013 | ..... | B66B 7/027 |
| GB | 2217296 | | 10/1989 | | |
| JP | H06255943 | A * | 9/1994 | | |
| JP | 5317037 | B2 * | 10/2013 | | |
| KR | 101923924 | | 11/2018 | | |
| WO | WO2000/07923 | | 2/2000 | | |
| WO | WO-2006022406 | A1 * | 3/2006 | ..... | B66B 19/005 |
| WO | WO-2011048275 | A1 * | 4/2011 | ..... | B66B 11/00 |
| WO | WO2019/068469 | | 4/2019 | | |

* cited by examiner

MACHINE ROOM-LESS ELEVATOR CONSTRUCTION

FIELD

The present invention relates generally to construction, and more particularly, to machine room-less elevator construction.

BACKGROUND

Elevators are a critical component of modern buildings. From modest office buildings, to high-rise apartments and skyscrapers, elevators are a necessity for transporting people and equipment to various levels of the buildings. Modern construction techniques typically utilize machine room-less (MRL) elevator systems. In such a system, the elevator motor and other mechanical, electronic, and/or electromechanical components are disposed above the elevator shaft, rather than utilizing a dedicated machine room that occupies valuable building space.

SUMMARY

The present invention discloses preferred embodiments of a method for constructing an elevator system within an elevator passage in a building. Specifically, the method starts with the installation of a support frame at the top of the elevator passage. A motor platform is attached to the support frame and the elevator motor is set on the motor platform. Elevator rails are installed in the elevator passage using the elevator motor from the bottom of the elevator passage to the top.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity. Furthermore, for clarity, some reference numbers may be omitted in certain drawings.

DETAILED DESCRIPTION

Disclosed embodiments provide an improved method for quickly and efficiently installing an elevator. A support frame is assembled at the top of an elevator passage. The permanent elevator motor is installed in the support frame. The permanent motor is then used to hoist materials as needed to build out the elevator system. The rails are installed starting from the bottom and working up to the top of the elevator passage. A novel support frame is used to provide the support for an initial hoist that is used to install the permanent motor. Once the permanent motor is installed, the car sling, temporary platform, and counter-weight frame are installed. Next the permanent elevator cables are installed. The permanent motor is then used to move the car sling and platform for the hoisting of the remainder of the materials used to build the elevator. This saves considerable time as compared with previous known elevator construction methods.

A base aligner is installed at the base of the elevator passage (shaft). The base aligner includes two pit rails, each of which comprise lengths of channel steel with brackets on each end for the purpose of attaching the car and counter-weight rails. The channel steel bolts together to form a tee shape and correctly locates the car rails in the X plane and the counterweight rails in the Y plane and also both sets of rails to each other. Next, three lasers are placed on the pit steel assembly on alignment marks so the beam travels up to the top of the elevator passage.

Figure 1A:
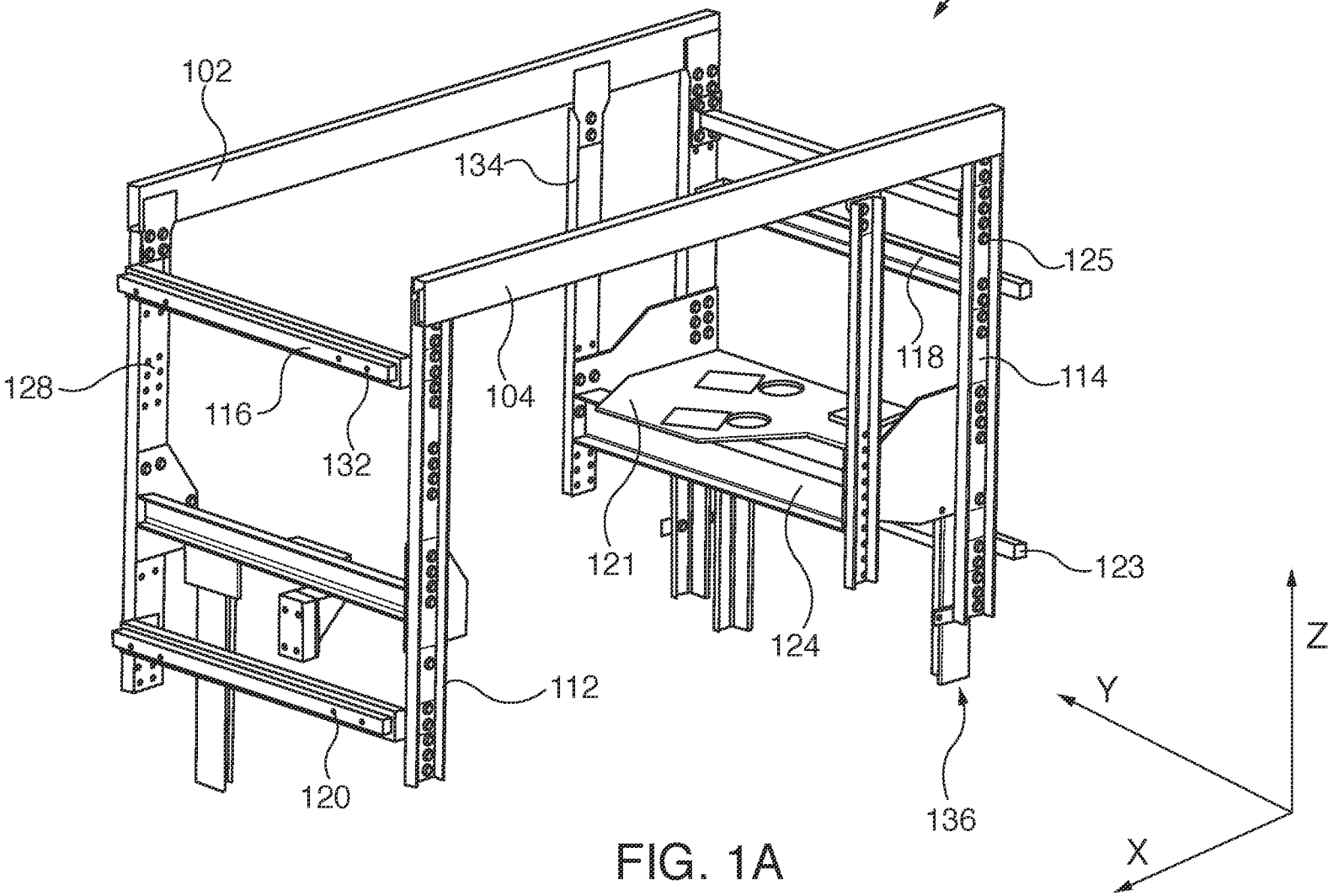
FIG. 1A shows a perspective view of a support frame in accordance with disclosed embodiments.
Figure 1B:
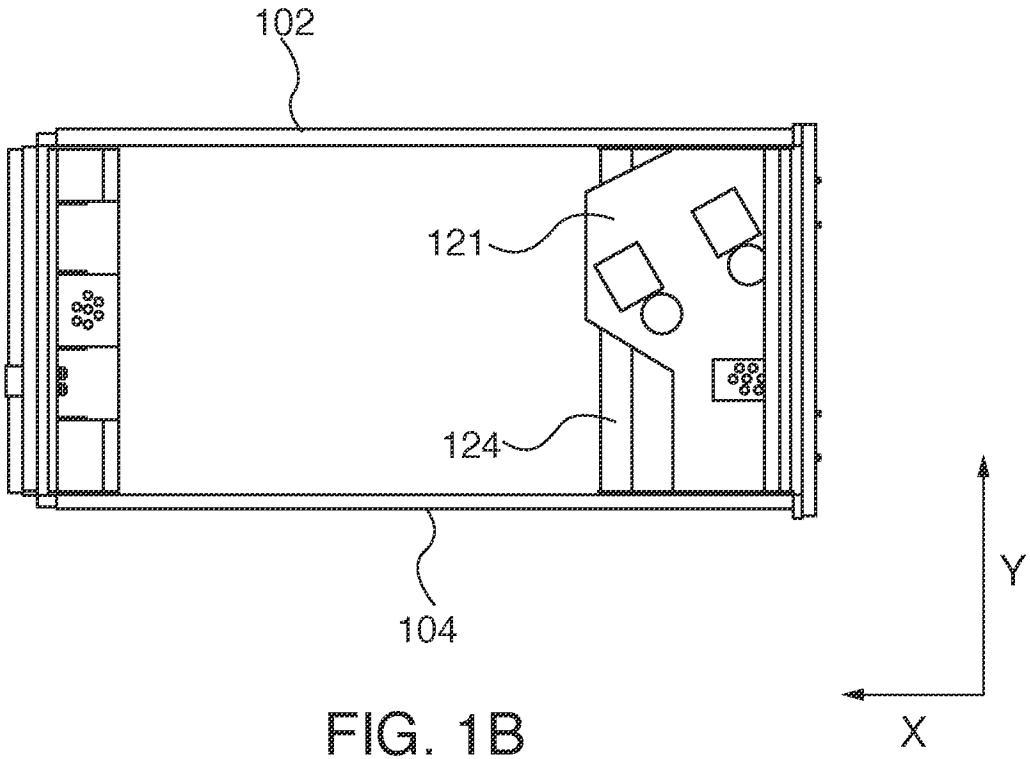
FIG. 1B shows a top-down view of a support frame in accordance with disclosed embodiments.

FIG. 1A shows a perspective view of a support frame 100 in accordance with disclosed embodiments. FIG. 1B shows a top-down view of the support frame 100 of FIG. 1A. The support frame 100 includes a plurality of lateral anchor beams, indicated as 116, 118, 120, and 123.

To begin an elevator installation using the disclosed embodiments, a base aligner is installed at the bottom of an elevator passage. Lasers are mounted to the base aligner and directed upwards for the purposes of ensuring that the support frame to be built at the top of the elevator is aligned properly with the base. This is important for ensuring that the elevator rails are properly aligned.

Figure 7:
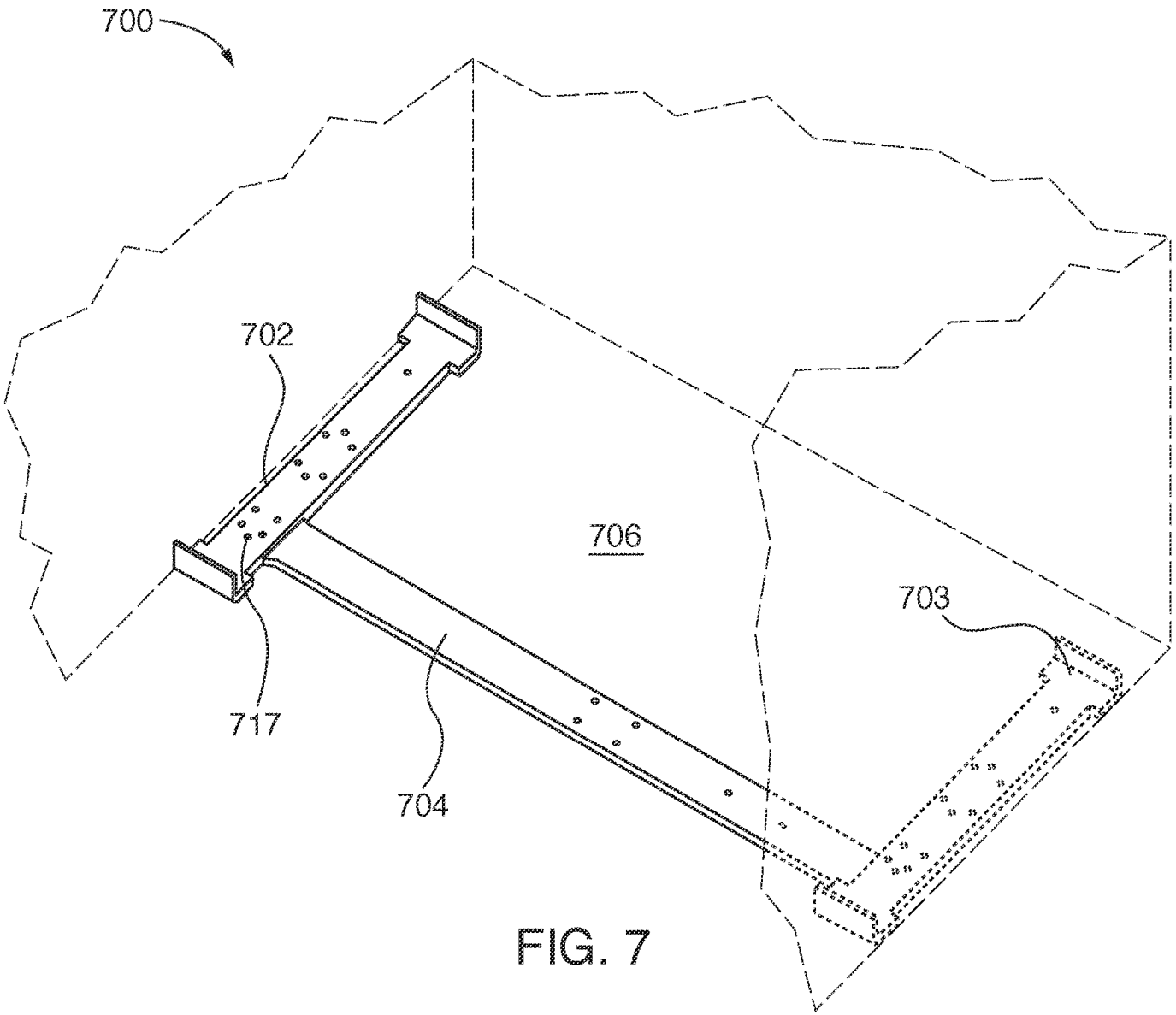
FIG. 7 shows details of a base aligner in accordance with disclosed embodiments.

Once the base aligner and lasers are in place, the lateral anchor beams are affixed to an interior lateral surface (e.g. wall) of an elevator passage. The lateral anchor beams are installed using the lasers which were placed on the base aligner in the previous step to ensure the machine frame is properly aligned to pit rail channels within the base aligner. FIG. 7 shows additional details of the base aligner including the pit channels. Each lateral anchor beam has a plurality of openings (indicated generally as 132), through which fasteners traverse in order to secure the lateral beams to the walls of the elevator passage. Thus, in embodiments, each lateral anchor beam from the plurality of lateral anchor beams comprises a plurality of fastener openings therein. The fasteners may include masonry bolts or other suitable fasteners. Slotted brackets are used throughout the construction of the support frame and elevator rails to enable positional adjustment during the alignment process.

Once the lateral anchor beams are installed, a plurality of vertical corner beams (indicated as 112, 114, 128, and 130,) are affixed to the lateral anchor beams utilizing a plurality of fasteners, such as bolts, indicated generally as 125 (FIG. 1A). In a preferred embodiment, four vertical corner beams are used, one in each corner of a rectangular elevator passage.

Figure 1C:
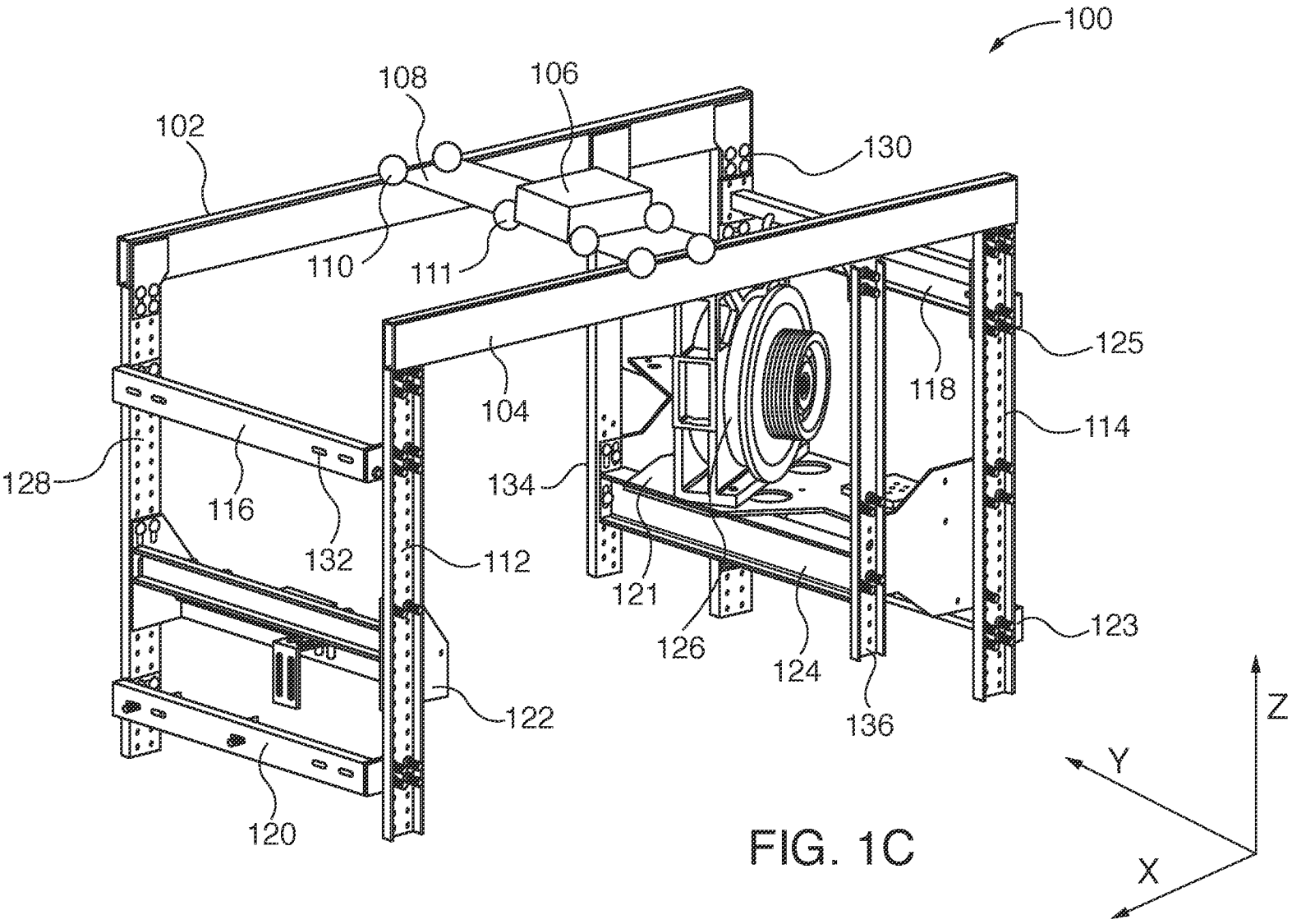
FIG. 1C shows a perspective view of a support frame with hoist in accordance with disclosed embodiments.

Once the vertical corner beams are installed, a plurality of top rails (indicated as 102 and 104) are installed. The top rails can serve as rails for a hoist 106 that is mounted on a hoist platform 108 as indicated in FIG. 1C. In this embodiment, the platform 108 is moveable along the top rails 102, 104. In this embodiment, the hoist 106 is disposed on a hoist platform 108, wherein the hoist platform is moveable along the top rails 102, 104. In this embodiment, a plurality of wheels, indicated generally as 110, engage with the top rails to allow smooth movement of the hoist 106 in the X dimension along the top rails. A plurality of wheels, indicated generally as 111, on the hoist platform also allow movement of the hoist along the hoist platform in the Y dimension. This gives the installer the ability to move the hoisted load in both X and Y dimensions which saves considerable time. The hoist 106 may include an electric motor, or in some embodiments, may be a manually operated hoist. In some embodiments, the operation of the hoist 106 to raise and lower and/or move along the X and Y axis may be controlled remotely via a wired or wireless interface.

Once the hoist 106 is installed, the hoist 106 can then be used to bring additional components to the support frame 100 for installation via a hoist cable (not shown). Using hoist 106, additional "intermediate" vertical spars 134 and 136 may be installed to support a machine frame 124. The intermediate vertical spars 134 and 136 are so named because they affix to the top rails at an intermediate point between the two ends of the top rails. Thus, embodiments can include a plurality of intermediate vertical beams affixed to both the machine frame and a top rail from the plurality of top rails.

The machine frame 124 may be hoisted to the support frame and installed via fasteners such as bolts. The single rail hitch plate 122 is also hoisted to the support frame and installed via fasteners such as bolts. The single rail hitch plate 122 may be used for attaching the hoist cables which come from one side of the car frame. Thus, preferred embodiments can include a single rail hitch plate affixed to a subset of vertical corner beams from the plurality of vertical corner beams.

Once the machine frame 124 is installed, the hoist 106 is used to raise and install the permanent elevator motor 126. The permanent elevator motor 126 (FIG. 1C) is affixed to the machine frame 124 via fasteners such as bolts. The term "permanent elevator motor" refers to the motor that is used to induce vertical movement in the elevator of a completed building. This is in contrast to prior art "temporary elevator motors" that are installed and used to power temporary elevators within the elevator passage during the construction of an elevator system in a new building. With the disclosed embodiments, the use of a temporary elevator motor is eliminated. This translates to reduced installation time, cost, and complexity, allowing construction projects to be completed more quickly.

Once the permanent elevator motor 126 is installed, the permanent elevator motor 126 may be used to move the car frame and platform for hoisting additional supplies as needed during the elevator construction. In some embodiments, the hoist 106 and platform 108 may be removed at this time. The components that comprise the support frame 100 such as the top rails, vertical spars, lateral anchor beams, vertical corner beams, machine frame, and other components, may be comprised of steel, or other suitable material. Fasteners such as bolts, nuts, washers, and/or lock washers may also be comprised of steel, or other suitable material. In some embodiments, rivets, and/or welds may be used instead of, or in addition to, fasteners in assembly of the support frame 100.

Figure 2A:
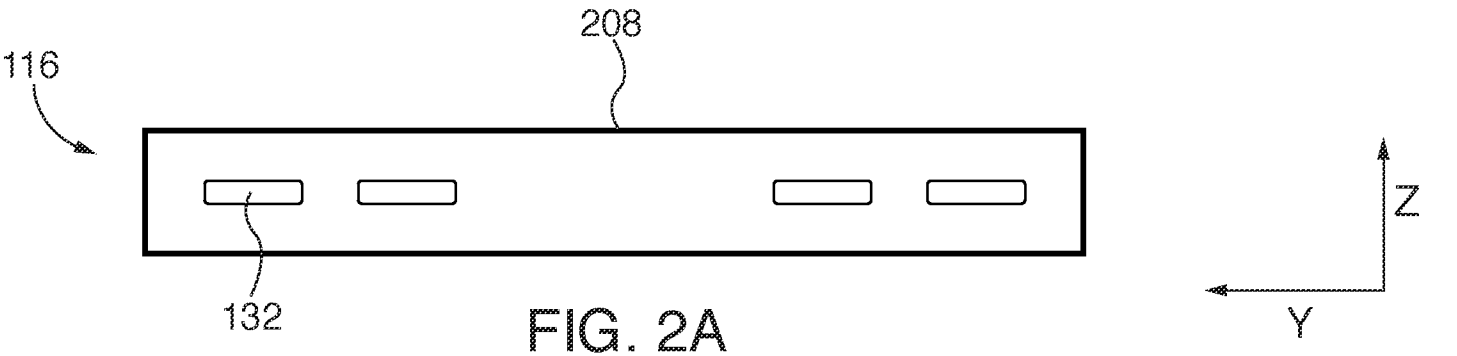
FIG. 2A shows a front view of a lateral anchor beam.
Figure 2B:
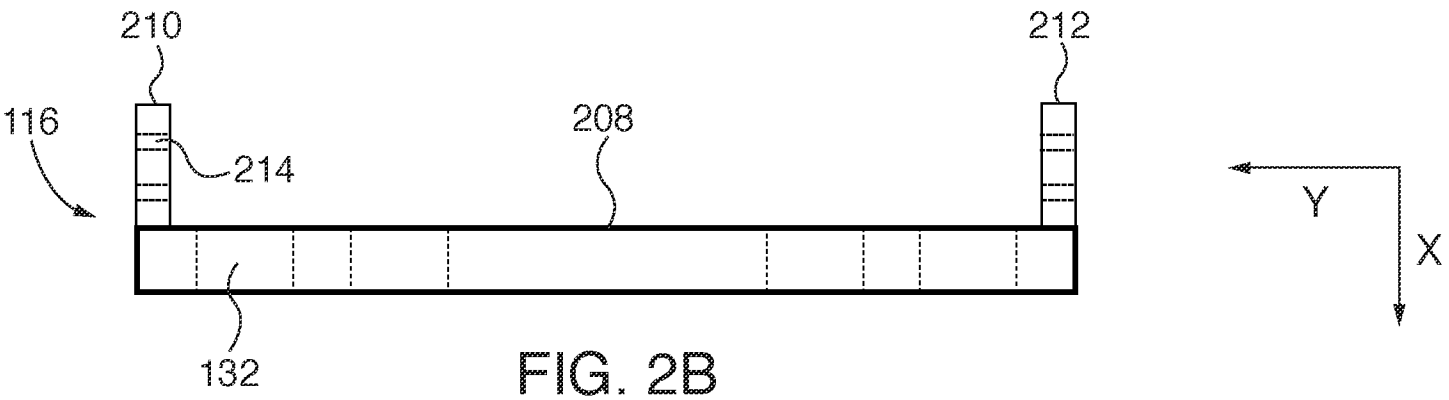
FIG. 2B shows a top-down view of a lateral anchor beam.
Figure 2C:
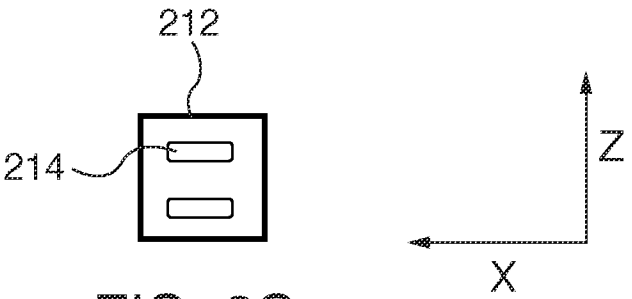
FIG. 2C shows a side view of a lateral anchor beam.

FIGS. 2A-2C show additional details of lateral anchor beam 116, which is identical to the other lateral anchor beams depicted in FIG. 1. FIG. 2A shows a front view of lateral anchor beam 116, which shows a plurality of openings (indicated generally as 132) formed within elongated section 208, through which fasteners traverse in order to secure the lateral beams to the walls of the elevator passage. In some embodiments, the openings 132 are oblong shaped as shown in FIG. 2A, in other embodiments, the openings 132 may be circular in shape. FIG. 2B shows a top-down view of lateral anchor beam 116, which shows two support flanges, indicated as 210 and 212. Each support flange has a plurality of openings, indicated generally as 214, to enable connection of vertical corner beams. FIG. 2C shows a side view of lateral anchor beam 116, indicating that in the embodiment shown, each support flange comprises four openings 214. Support flange 212 may be identical to support flange 210. Some embodiments may have more or fewer openings in the support flanges than the four that are shown in FIG. 2C.

Figure 3:
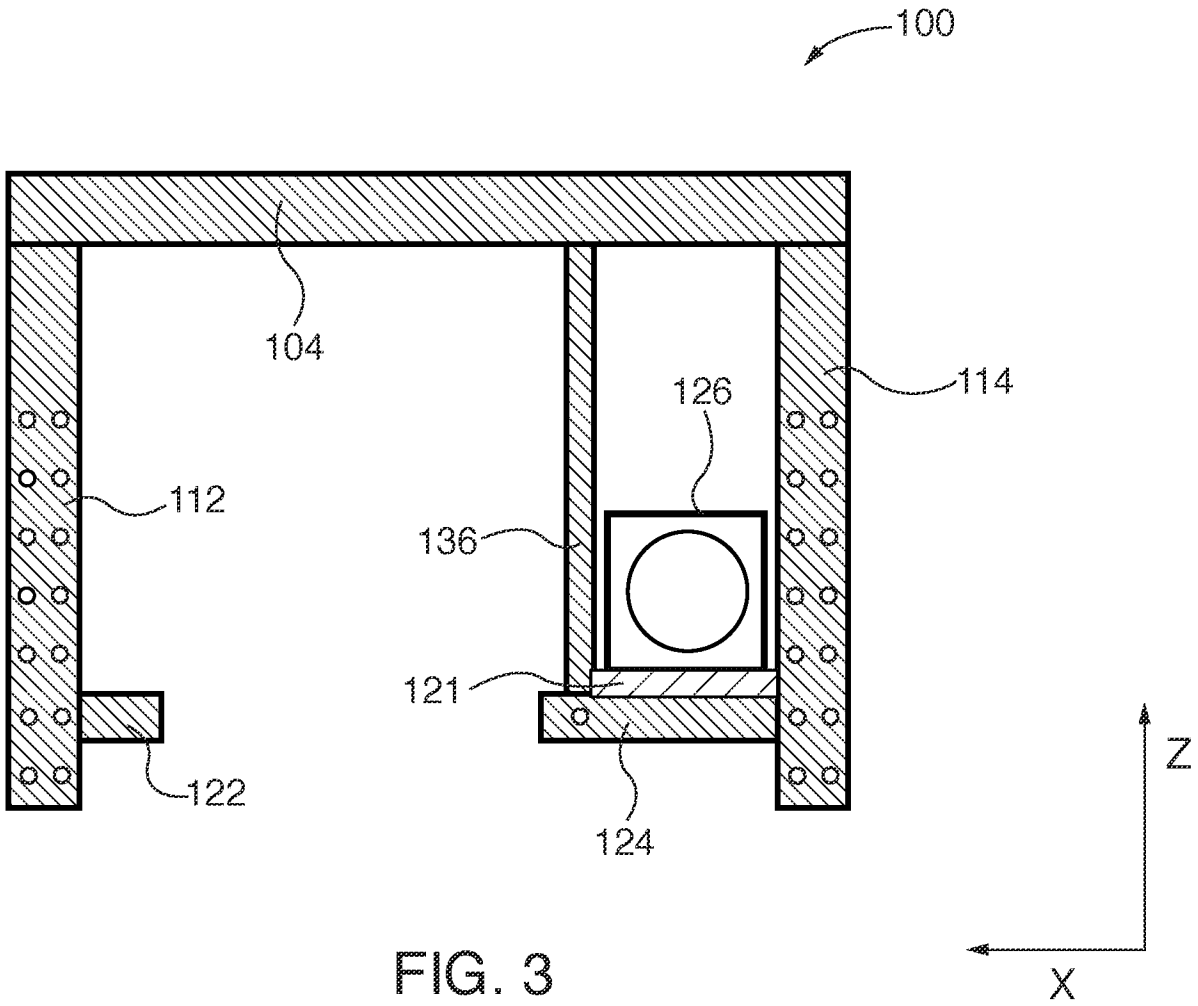
FIG. 3 shows a side view of support frame in accordance with disclosed embodiments.

FIG. 3 shows a side view of support frame 100 in accordance with disclosed embodiments. As shown in FIG. 3, the permanent motor 126 is installed on the motor platform 121 of the machine frame 124, which is supported by vertical spars 134 (see FIG. 1A) and 136. For disclosed embodiments, the assembly shown in FIG. 3 is installed at the top of an elevator passage to allow efficient construction of a permanently installed elevator system within a building. The elevator system can include rails, an elevator car, counterweight frames and counterweights, pullies, cables, clutches, brakes, electronic controls, electromechanical controls, and/or other elevator components. The various components of the support frame 100 such as the vertical spars 134 and 136, and machine frame 124 may be comprised of steel or other suitable material.

Figure 4A:
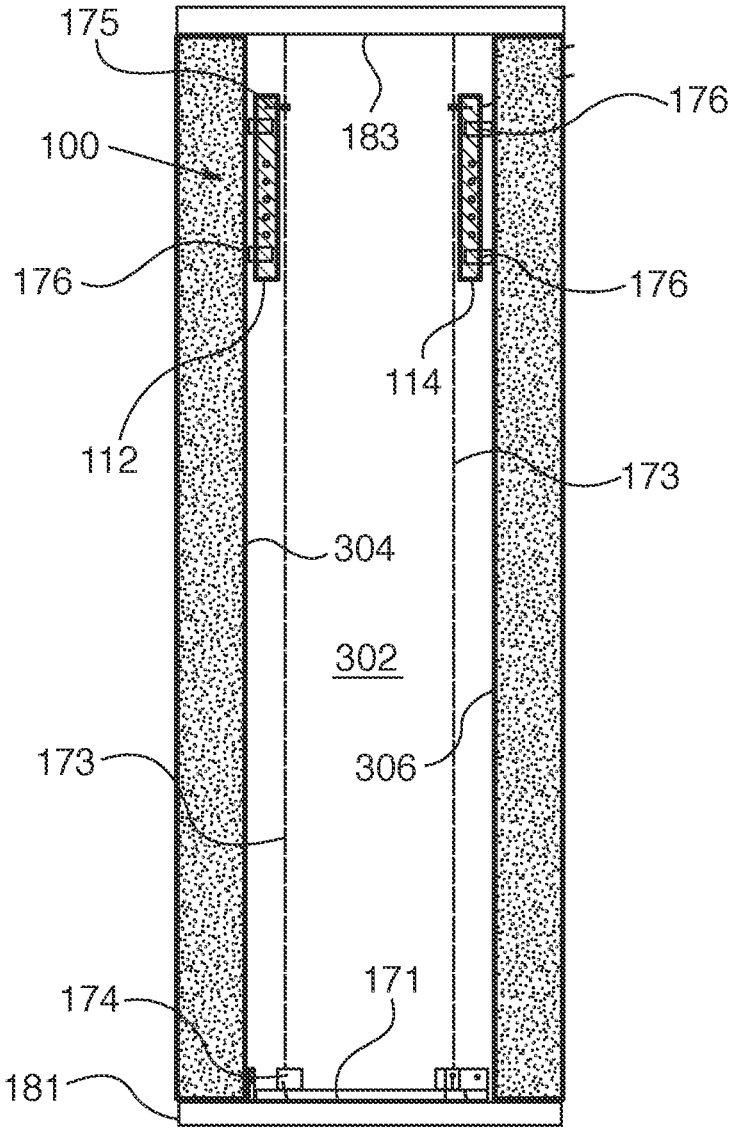
FIG. 4A shows initial steps of elevator construction in accordance with disclosed embodiments.

FIG. 4A shows a view of support frame 100 in accordance with disclosed embodiments installed in an elevator passage 302. The elevator passage 302 comprises lateral surfaces (walls) 304 and 306. The elevator passage 302 further includes a base surface 181, and a ceiling 183. Base surface 181 may be comprised of concrete, steel, or other suitable surface. As shown in FIG. 4A, the frame 100 is shown in a partially assembled state where the vertical corner beams (112, 114)) are installed. In preferred embodiments, the vertical corner beams may be affixed to the walls via anchor beams, indicated generally as 176. As shown in FIG. 1A, the anchor beams comprise slots to allow movement of a vertical corner beam closer to, or farther from a wall surface, such that the laser beam 173 passes through an alignment feature (e.g. hole, notch, etc.) on a laser alignment jig. In preferred embodiments, a laser alignment jig (indicated generally as 175) may be temporarily installed on each vertical corner beam. Lasers, indicated generally as 174, are disposed on a base aligner 171 (see FIG. 7 for details of a base aligner) that is disposed on the base surface 181 and oriented towards the ceiling 183. The laser beams may contact, pass through, or otherwise interact with, the laser beams 173 in order to align the vertical corner beams with the laser beams.

Figure 4B:
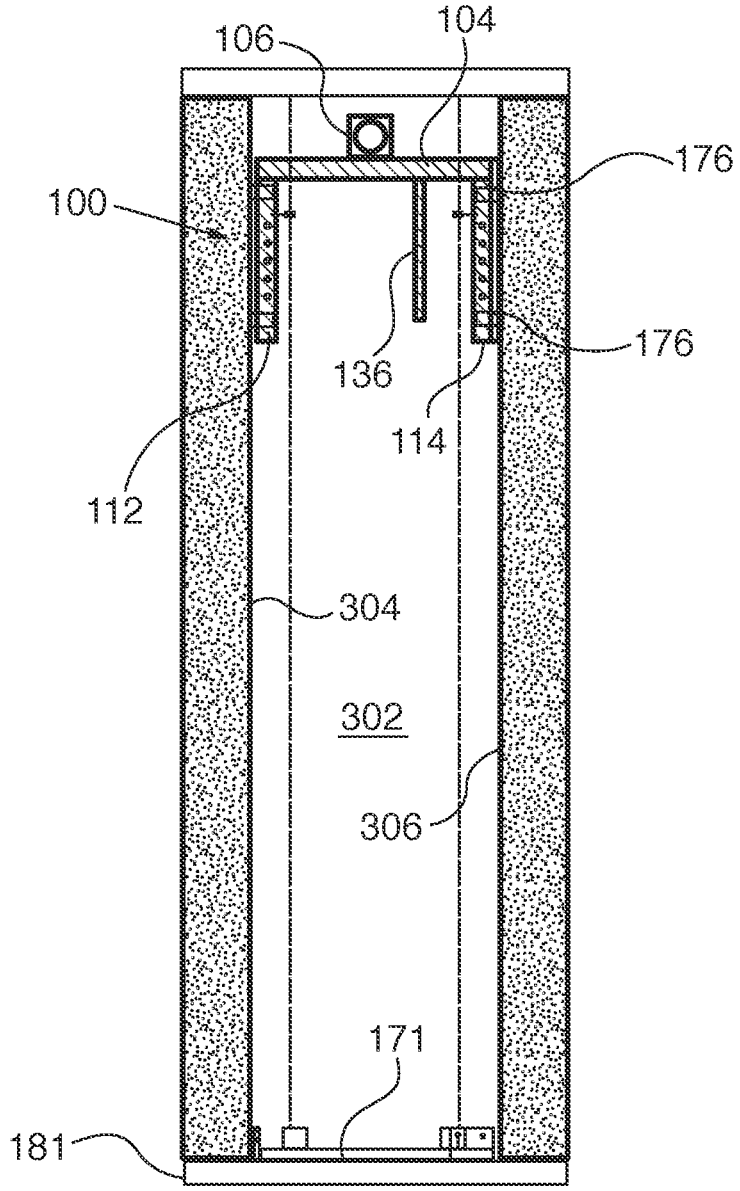
FIG. 4B-4F show additional steps of elevator construction in accordance with disclosed embodiments.

FIG. 4B shows a view of support frame 100 with the machine frame installed, in accordance with disclosed preferred embodiments. The hoist 106 is disposed on the support frame 100 to facilitate installation of additional components of the support frame.

Figure 4C:
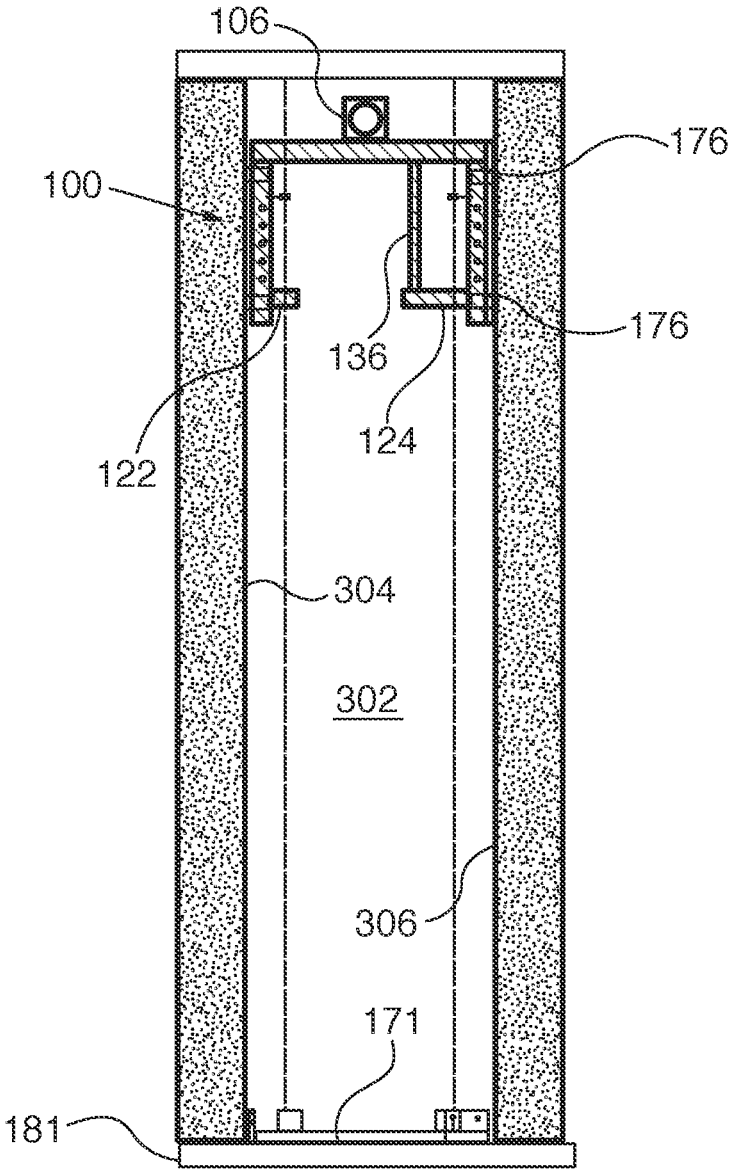

FIG. 4C shows a view of the support frame with the machine frame 124 installed, in accordance with disclosed embodiments. In preferred embodiments, the hoist 106 is used to lift the machine frame 124 into position via a connected cable (not shown). The machine frame is installed using the lasers to align it to the pit channels of the base aligner. Once the machine frame 124 is in position, it is fastened to the support frame vertical corner beams and vertical spars via fasteners such as bolts.

Figure 4D:
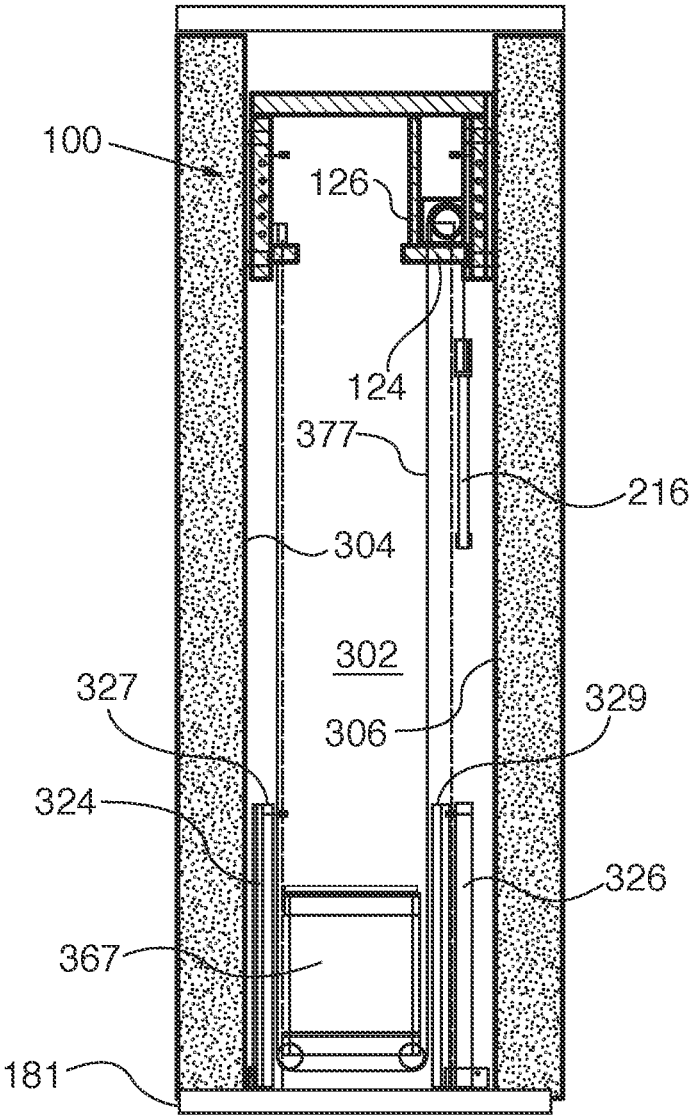

FIG. 4D shows the support frame after installation of the permanent motor 126, and initial rail installation, in accordance with disclosed embodiments. After machine frame and permanent hoist machine is set, the lasers are moved from the base aligner up to the machine frame using the same alignment holes used to set the machine frame. The lasers are then aimed downwards towards the base surface 181 in order to perform the alignment. The first rail sections are installed in place using rail jigs 327 and 329 to align them to the laser point from above. The rail jigs may include a loop or notch that the laser passes through as part of the alignment process. The rail jigs may be attached to rails via threaded shafts and nuts, or other suitable mechanism. Elevator car rails are installed starting from the bottom of the elevator passage 302 and working towards the top. As shown in FIG. 4D, elevator car rails 324 and 326 are installed. After the first section of rails are installed, the car frame 367 is installed. Hoist cables 377 are also installed to enable vertical movement of the elevator car frame 367. A temporary work platform is also installed at the top of the car frame to facilitate installation of each level of rails. Thus, once the construction of the rails and other components is complete using the permanent motor 126, the permanent motor 126 is also used for operation of an elevator car that moves vertically within the elevator passage 302. In preferred embodiments (and as shown in FIG. 4D), the hoist 106 may then be removed, since the permanent motor 126 has sufficient power to hoist any rails, and/or temporary elevator car for transporting such materials. A counterweight system 216 is also installed.

In some preferred embodiments, the hoist 106 is removed upon installation of the permanent motor 126. The hoist 106 is relatively light duty compared to the power of the permanent motor 126. The hoist 106 need only to be of sufficient power to lift the permanent motor 126 and other components of the support frame 100. In some embodiments, the hoist 106 has a lifting capability ranging from 300 kilograms to 1,000 kilograms, while the permanent motor 126 may have a lifting capability ranging from 3,000 kilograms to 4,200 kilograms. Thus, the permanent motor is more than powerful enough to lift the additional materials used to complete the construction of the elevator. The temporary hoist 106 can be removed once the permanent motor is installed. These are some of the major advantages of disclosed embodiments.

Figure 4E:
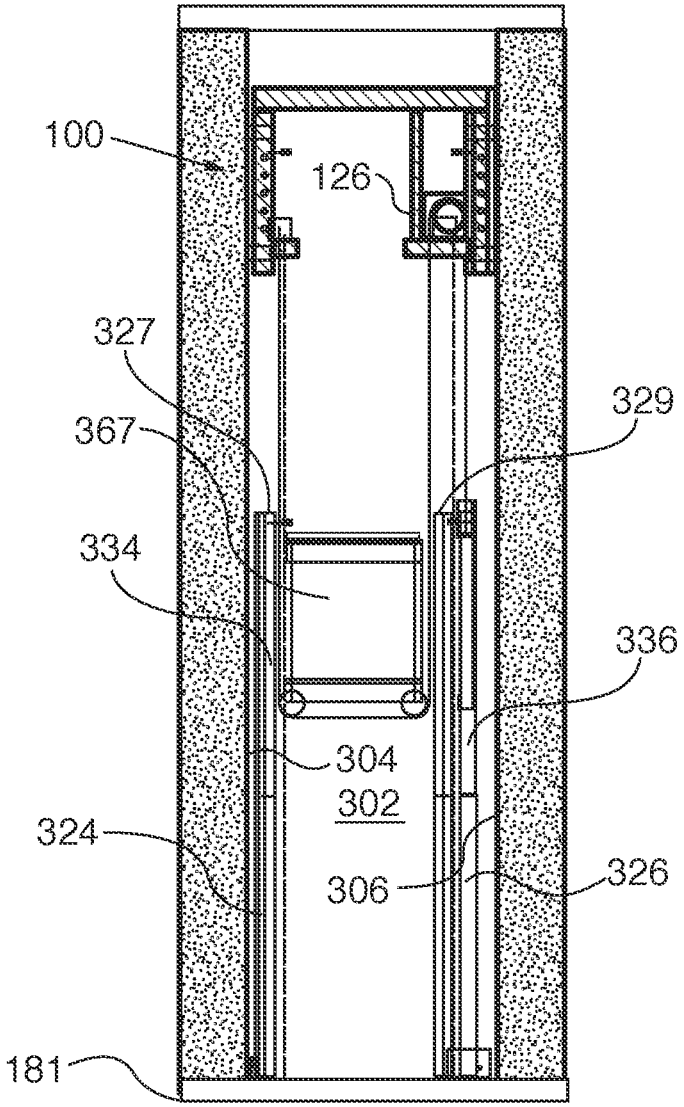
Figure 4F:
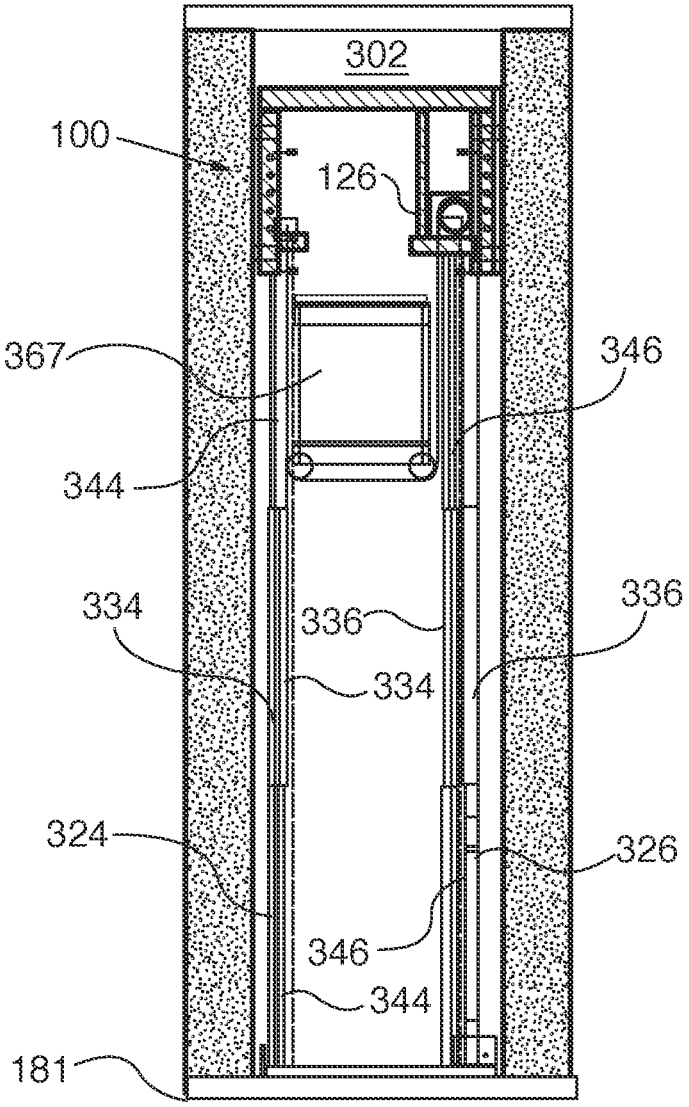

FIG. 4E shows the elevator system with additional elevator car rails installed (334 and 336). FIG. 4F shows the elevator system with additional elevator car rails installed (344 and 346). As can be seen in FIGS. 4D-4F, rail installation starts at the bottom end of the elevator passage 302, and progresses towards the top of the elevator passage 302. The rail jigs 327 and 329 are moved to the next set of rails (334 and 336) to continue the alignment process.

Figure 5:
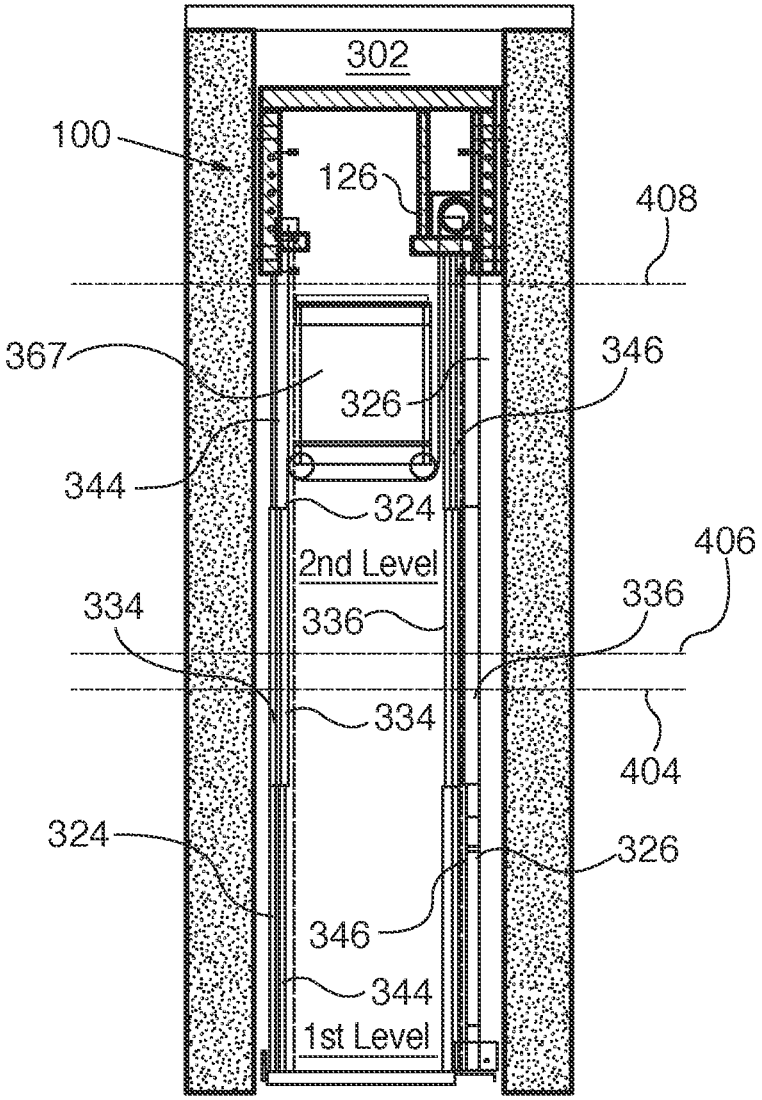
FIG. 5 shows a completed elevator installation, in accordance with disclosed embodiments.

FIG. 5 shows a completed elevator installation 400, in accordance with disclosed embodiments. Once the rails, counterweights, cables, pullies, and other necessary components are installed, the permanent motor 126 is used to vertically move the elevator car 367 to different floors (levels) of the building. Line 404 indicates a top of a first floor. Line 406 indicates a bottom of a second floor. Line 408 indicates a top of a second floor. In this example, the second floor is the top floor serviced by the elevator car 367. While two floors are shown in this example, in practice, there can be many more floors (levels). The support frame 100 is disposed above the top (line 408) of the top floor.

Figure 6:
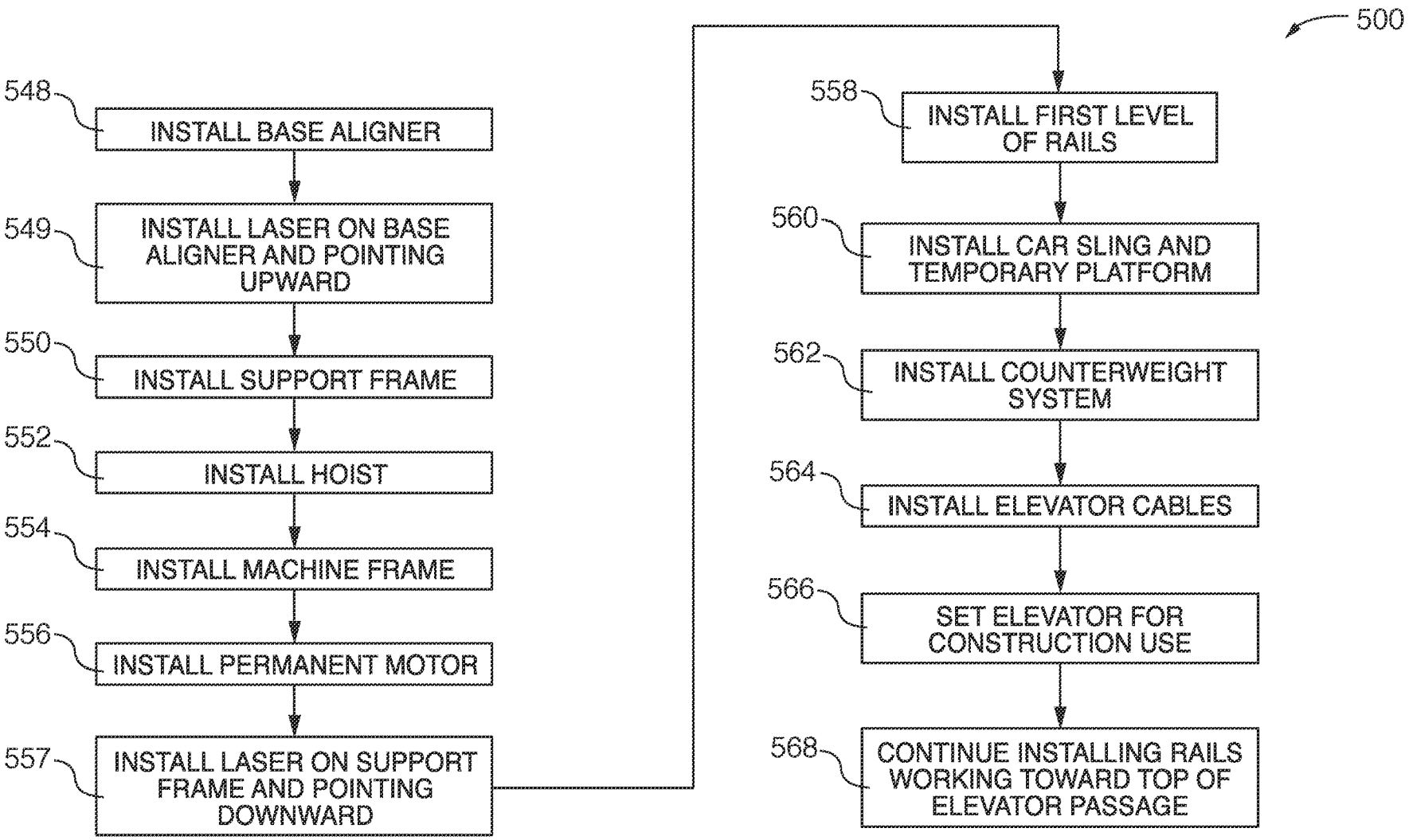
FIG. 6 is a flowchart for disclosed embodiments.

FIG. 6 is a flowchart 500 for disclosed embodiments. At 548, a base aligner is installed at the base of an elevator passage. At 549, one or more lasers are installed on the base aligner, such that the laser beams are directed upwards towards the top of the elevator passage. At 550, a support frame is installed at the top of the elevator passage, aligned in position using the lasers installed on the base aligner. At 552, a hoist is installed on the support frame (see 106 of FIG. 4B). At 554, a machine frame is installed (see 124 of FIG. 4B), which is used to support a permanent motor. At 556, a permanent motor is installed (see 126 of FIG. 4D). The permanent motor is used to operate the elevator car of a completed elevator system. Disclosed embodiments facilitate early installation of the permanent motor, and then utilize the lifting capability of the permanent motor to carry construction materials in order to complete the assembly of an elevator system. This provides the advantage of additional testing time and "burn-in" for the permanent motor and associated components prior to operational use in conveyance of elevator passengers and/or freight. At 557, the lasers are removed from the base aligner, and installed on the support frame. The lasers are oriented such that the laser beams are directed downward towards the base aligner and aligned with holes formed in the base aligner. At 558, the first set of rails are installed within the elevator passage, starting from the bottom of the elevator passage (see FIG. 4D). At 560, a car sling and temporary platform are installed. At 562, a counterweight system is installed (see 216 of FIG. 4D). At 564, elevator cables are installed (see 377 of FIG. 4D). At 566, the elevator is set for construction use. This may include disabling various interlocks or other systems to allow carrying large pieces such as rails, beams and subassemblies within the elevator passage. At 568, elevator rails are installed, working towards the top of the elevator passage, as illustrated in FIGS. 4D-4F, until the installation of elevator rails is complete at the topmost level of the elevator passage that is accessible to an elevator car.

FIG. 7 shows details of a base aligner 700, including the pit channels, in accordance with disclosed embodiments. Beams 702, 703 and 704 may be disposed at the base of an elevator passage. Beams 702 and 703, also referred to as "pit channels" may be affixed to the bottom surface 706 of the elevator passage (similar to 181 of FIG. 4A). Lasers may then be affixed to the pit channels and aimed upwards towards the ceiling (183 of FIG. 4A) of the elevator passage. A plurality of holes, indicated generally as 717 may be used to perform laser alignment. In preferred embodiments, the lasers are aligned such that the laser beams are parallel to the side walls of the elevator passage. These laser beams can then be used as reference for installing the other components of the elevator system as depicted in FIGS. 4A-4F.

Figure 8:
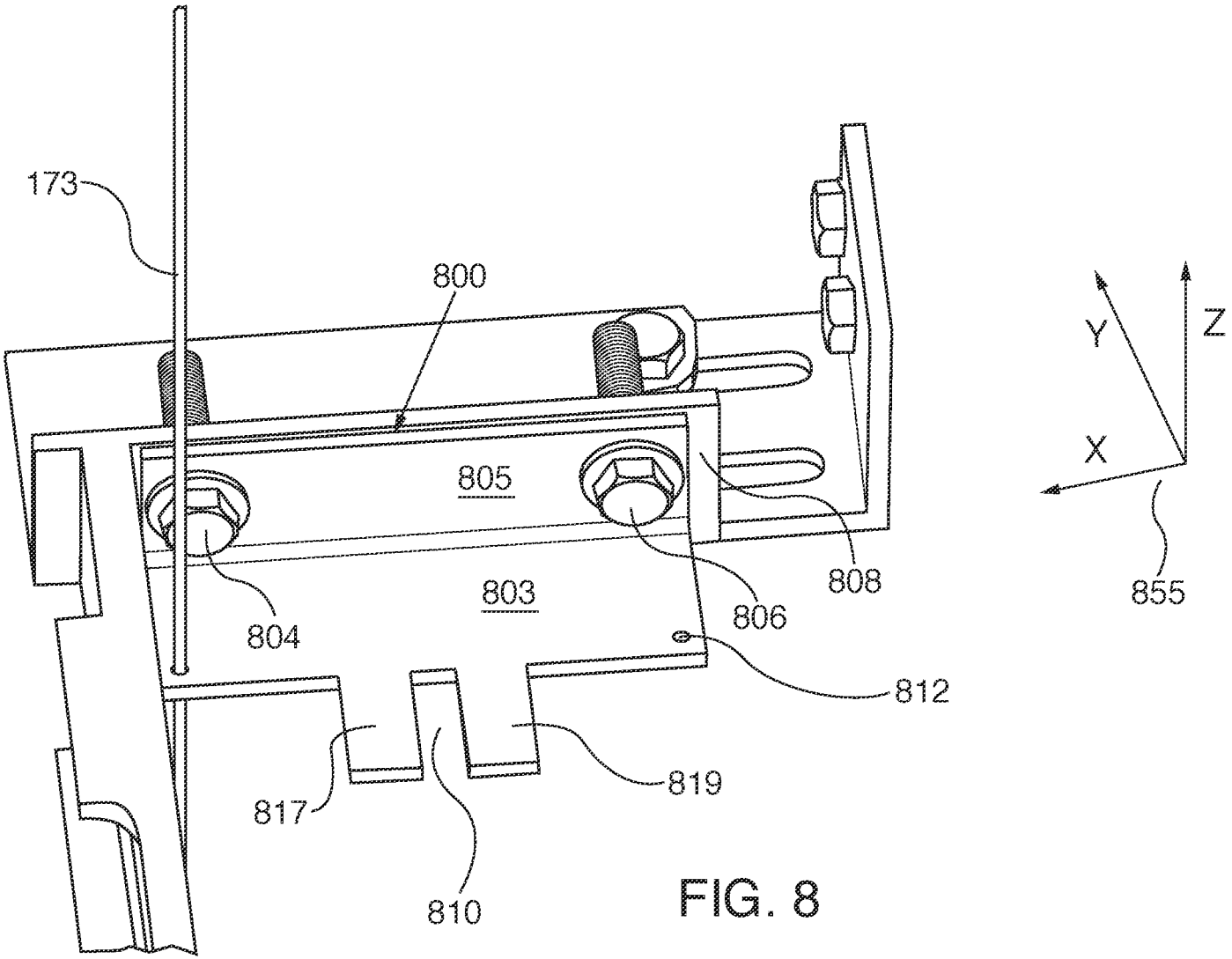
FIG. 8 shows an example usage of a frame alignment jig for a support frame.

FIG. 8 shows an example usage of a frame alignment jig 800 for a support frame. Jig 800 may be similar to jig 175 shown in FIG. 4A. Jig 800 includes a first plate 803 and a second plate 805 formed at a 90-degree angle. Two flanges, indicated as 817 and 819, extend outward from the first plate 803, forming a notch 810. A plurality of alignment holes, indicated generally as 812, are formed in the first plate 803. Second plate 805 includes a plurality of mounting holes (not shown) for enabling bolts 804 and 806 to be passed therethrough to secure the jig 800 to frame portion 808. A laser is aligned such that the laser beam 173 passes cleanly through an alignment hole. In preferred embodiments, the laser is located above the jig 800, and aimed downwards towards the bottom of the elevator passage to start the process. Legend 855 indicates the X, Y, and Z dimensions for FIG. 8.

Figure 9:
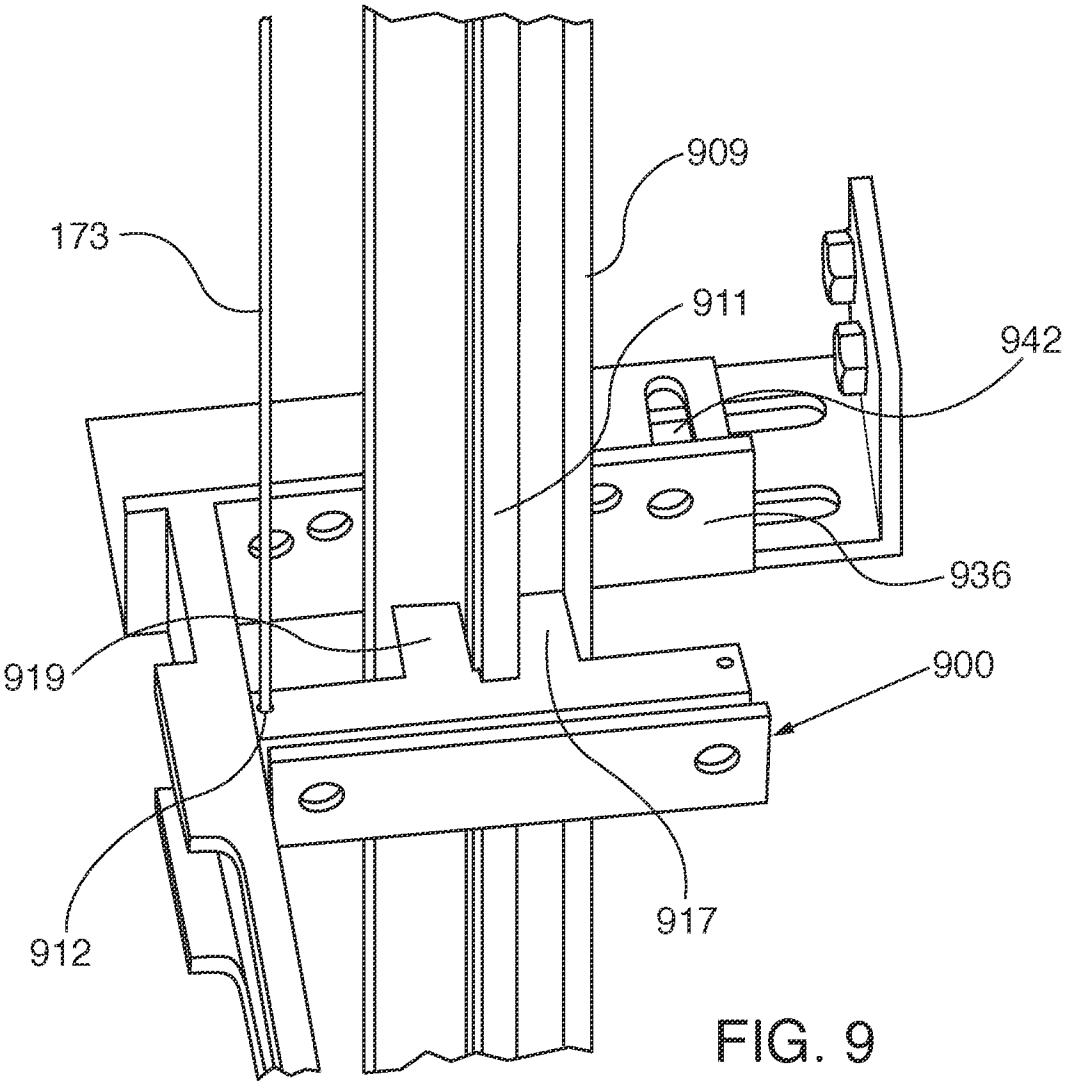
FIG. 9 shows an example usage of a rail alignment jig.

FIG. 9 shows an example usage of a rail alignment jig 900. In preferred embodiments, rail alignment jig 900 may be similar to jig 800 of FIG. 8. A rail 909 is installed to a support 936. The rail 909 has a ridge 911 disposed along a longitudinal axis. The jig is placed such that the notch (see 810 of FIG. 8) is placed around the ridge 911 such that the flanges 917 and 919 are placed against the rail 909. In preferred embodiments, the jig 900 may be held in place by an installer during the alignment process. The hardware for mounting rails and frame members includes a plurality of slotted openings (indicated generally as 942). The slotted openings allow for horizontal and/or vertical adjustment of rails and other components in order to align them using the laser beam 173. The laser beam 173 passes through alignment hole 912 when the rail 900 is properly aligned. The fine-tuning of the rail position may be accomplished through shims, washers, slight adjustments of the position of support 936 within the elevator passage, and/or other suitable technique.

In preferred embodiments, the frame alignment jig 800 may be the same component as the rail alignment jig 900, but oriented differently for use in each application. Referring again to FIG. 8, the jig 800 has second plate 805 bolted to frame portion 808. Referring now once more to FIG. 9, in embodiments, the frame alignment jig 800 is oriented in an opposite manner such that the notch (see 810 of FIG. 8) is placed around the ridge 911 such that the flanges 917 and 919 are placed against the rail 909. In these embodiments, a single component may be used for alignment of both the rails and the machine frame.

Figure 10A:
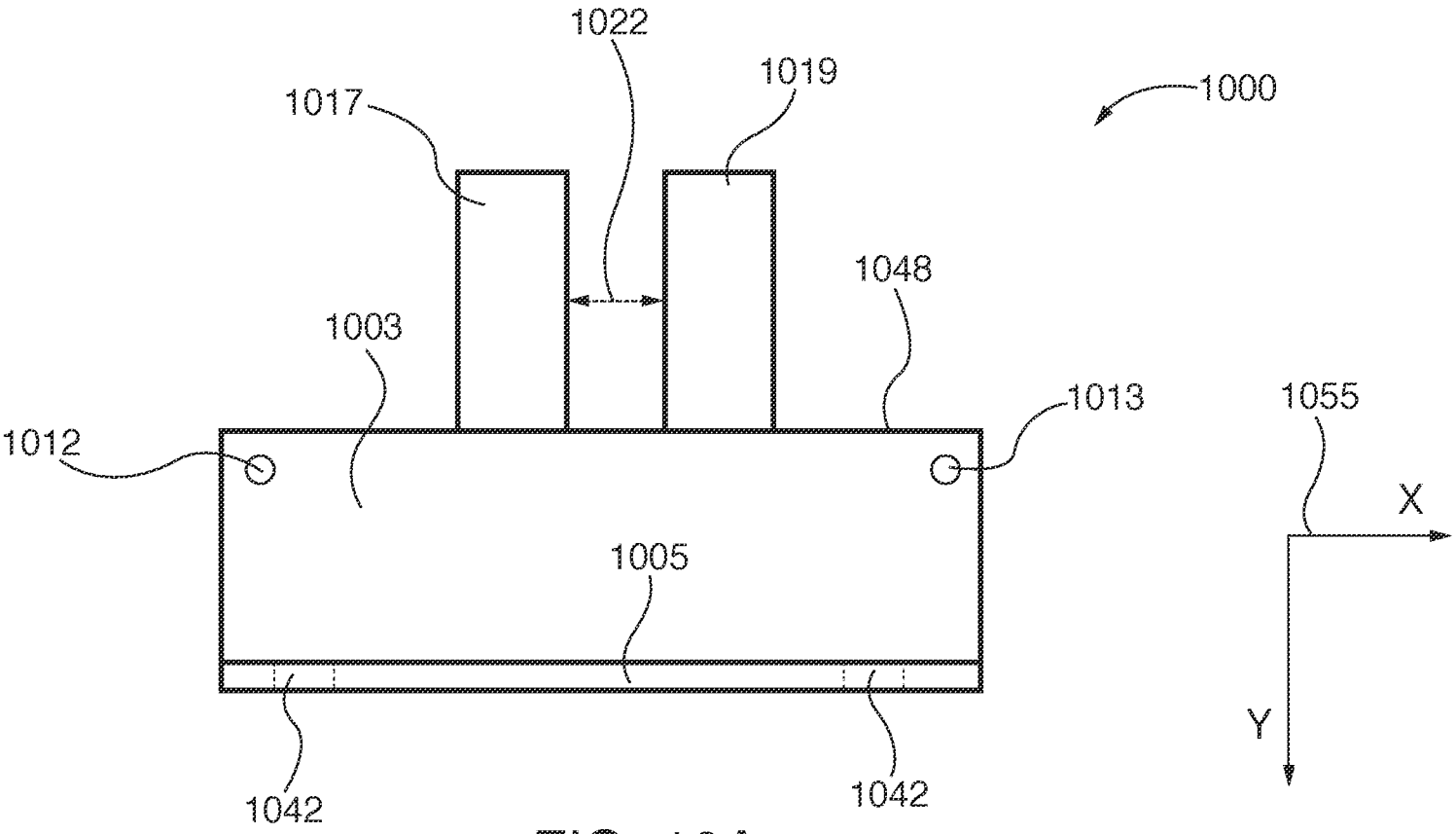
FIGS. 10A-10C show details of an alignment jig used for both frame alignment and rail alignment in accordance with embodiments of the present invention.
Figure 10B:
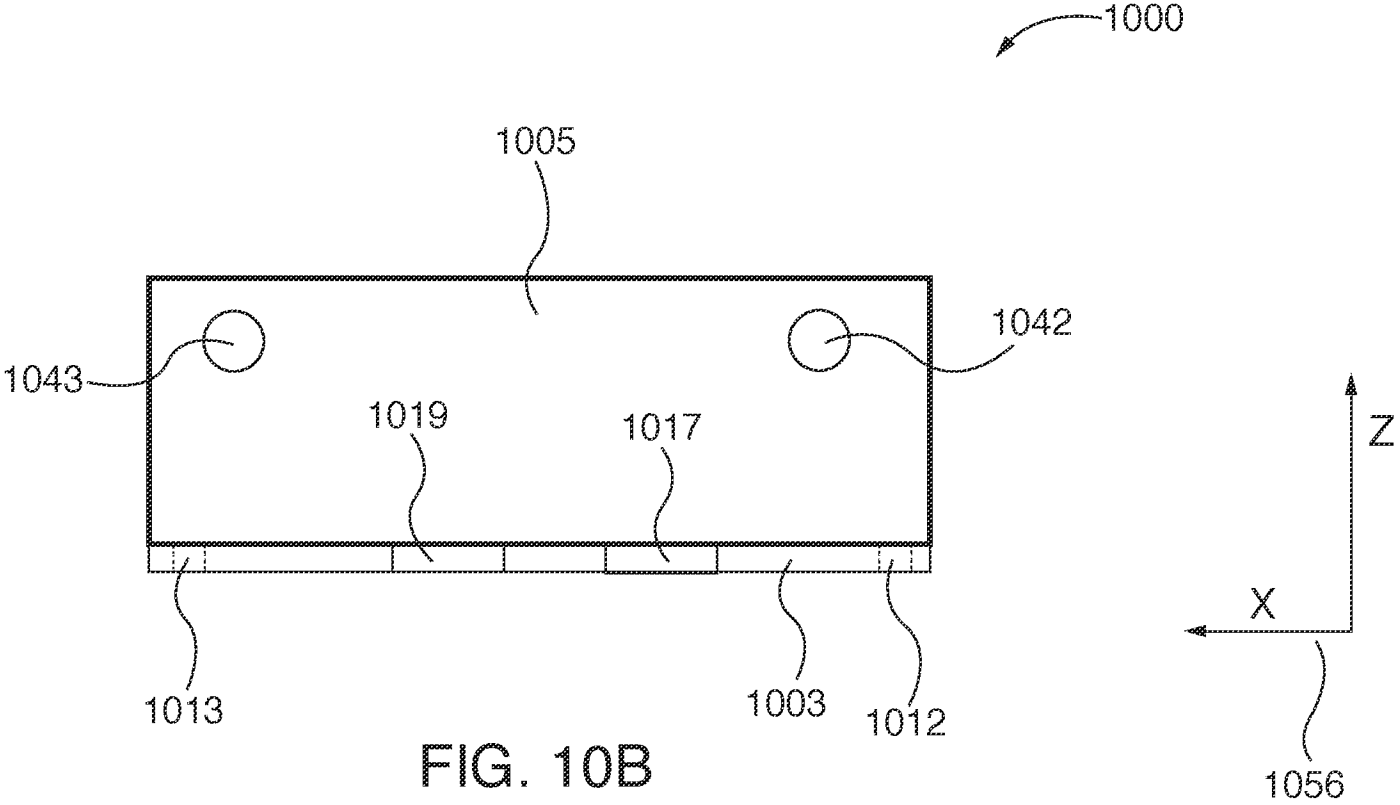
Figure 10C:
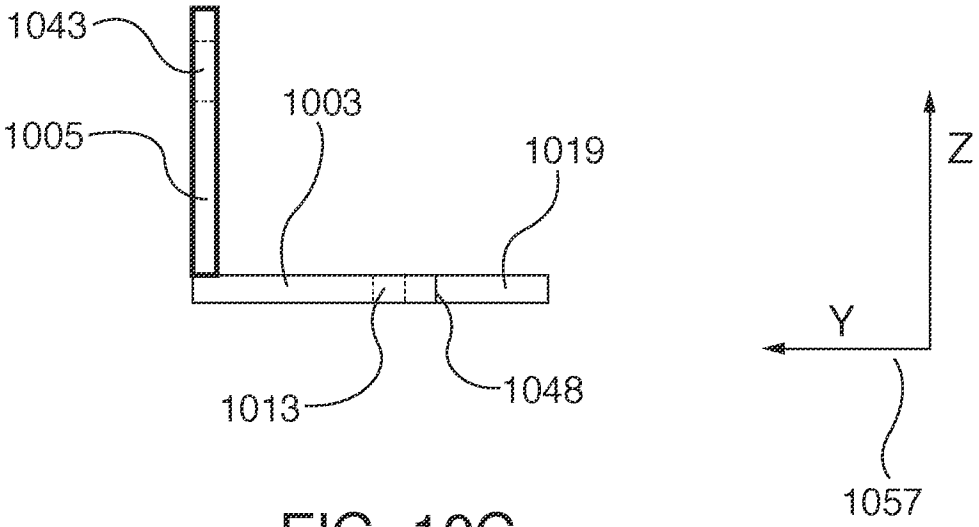

FIGS. 10A-10C show details of an alignment jig 1000 used for both frame alignment and rail alignment in accordance with embodiments of the present invention. FIG. 10A shows a top-down view of jig 1000. FIG. 10B shows a front view of the jig of FIG. 10A. FIG. 10C shows a side view of the jig of FIG. 10A. Legend 1055 indicates the X and Y dimensions for FIG. 10A, based on the legend 855 of FIG. 8. Legend 1056 indicates the X and Z dimensions for FIG. 10B. Legend 1057 indicates the Y and Z dimensions for FIG. 10C. The alignment flanges 1017 and 1019 extend beyond outer edge 1048 of first plate 1003, and are spaced apart by a gap 1022. The gap 1022 is configured to fit over a ridge of an elevator rail. In embodiments, the gap 1022 may range from 1 centimeter to 5 centimeters. First plate 1003 has laser alignment holes 1012 and 1013 formed therein. Second plate 1005 is affixed to second plate 1005, and oriented perpendicularly to first plate 1003. Second plate 1042 has mounting holes 1042 and 1043 formed therein for securing to a frame component when the jig 1000 is being used as a frame alignment jig. In embodiments, alignment jig 1000 may be comprised of a metal such as steel, aluminum, copper, or alloy thereof. In some embodiments, alignment jig 1000 may be comprised of a rigid plastic.

As can now be appreciated, disclosed embodiments provide an improved method for quickly and efficiently installing an elevator. A support frame is assembled at the top of an elevator passage. The permanent elevator motor is installed in the support frame. The permanent motor is then used to hoist materials as needed to build out the elevator system. Once built, the permanent motor that is already installed and has had hours of usage to verify its operation, is used for movement of the elevator car. The methods of disclosed embodiments utilize a novel support frame that can be easily installed in an elevator passage to start the building of the elevator system.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A method for constructing an elevator within an elevator passage, comprising:

installing a support frame at a top end of the elevator passage;

installing a motor platform on the support frame;

installing a permanent elevator motor on the motor platform; and installing a plurality of elevator rails within the elevator passage, wherein the installing of the plurality of elevator rails starts at a bottom end of the elevator passage, and wherein a subset of the plurality of elevator rails are hoisted by the permanent elevator motor, and wherein the permanent elevator motor is used for operation of an elevator car that moves vertically within the elevator passage; and utilizing a laser alignment jig to align the plurality of elevator car rails, wherein the laser alignment jig comprises a plurality of alignment holes in a first plate, and a second plate affixed perpendicularly to the first plate, wherein the second plate comprises a plurality of mounting holes, and a notch formed in the first plate, wherein the notch is formed by space between a first flange and a second flange, the notch sized to accommodate a ridge of each rail of the plurality of elevator rails, wherein the ridge of each rail is narrower than a width of the rail, the ridge is located at a lateral center of the width, and the notch being sized such that the notch is narrower than the width of the rail, and sized so that the ridge is positioned between the first flange and the second flange.

2. The method of claim 1, wherein the installing of the plurality of elevator rails completes at a top end of the elevator passage.

3. The method of claim 1, wherein installing the support frame comprises anchoring the support frame to a lateral surface of the elevator passage.

4. The method of claim 1, further comprising installing a hoist on the support frame.

5. The method of claim 4, further comprising removing the hoist after the installing of the permanent elevator motor.

6. The method of claim 1, further comprising installing a counterweight system.

7. A support frame for elevator installation, comprising:

a plurality of lateral anchor beams;

a plurality of vertical corner beams, wherein each vertical corner beam of the plurality of vertical corner beams is connected to a subset of lateral anchor beams from the plurality of lateral anchor beams;

a plurality of top rails affixed to a top end of the vertical corner beams;

a machine frame affixed to a subset of vertical corner beams from the plurality of vertical corner beams;

a motor platform affixed to the machine frame; and wherein each vertical corner beam from the plurality of vertical corner beams further comprises a common laser alignment jig, wherein each laser alignment jig comprises a plurality of alignment holes in a first plate, and a second plate affixed perpendicularly to the first plate, wherein the second plate comprises a plurality of mounting holes, and a notch formed in the first plate, wherein the notch is formed by space between a first flange and a second flange, the notch sized to accommodate a ridge of an elevator rail, wherein the ridge of each rail is narrower than a width of the rail, the ridge is located at a lateral center of the width, and the notch being sized such that the notch is narrower than the width of the rail, and sized so that the ridge is positioned between the first flange and the second flange.

8. The support frame of claim 7, further comprising a single rail hitch plate affixed to a subset of vertical corner beams from the plurality of vertical corner beams.

9. The support frame of claim 7, further comprising a hoist.

10. The support frame of claim 9, wherein the hoist is disposed on a hoist platform, wherein the hoist platform is moveable along the plurality of top rails.

11. The support frame of claim 7, further comprising a plurality of intermediate vertical beams affixed to both the machine frame and a top rail from the plurality of top rails.

12. The support frame of claim 7, wherein each lateral anchor beam from the plurality of lateral anchor beams comprises a plurality of fastener openings therein.

13. A support frame for elevator installation, comprising:

a plurality of lateral anchor beams;

a plurality of vertical corner beams, wherein each vertical corner beam of the plurality of vertical corner beams is connected to a subset of lateral anchor beams from the plurality of lateral anchor beams;

a plurality of top rails affixed to a top end of the vertical corner beams;

a machine frame affixed to a subset of vertical corner beams from the plurality of vertical corner beams;

a hoist platform disposed on the plurality of top rails;

a hoist disposed on the hoist platform;

a motor platform affixed to the machine frame; and wherein each vertical corner beam from the plurality of vertical corner beams further comprises a common laser alignment jig, wherein each laser alignment jig comprises a plurality of alignment holes in a first plate, and a second plate affixed perpendicularly to the first plate, wherein the second plate comprises a plurality of mounting holes, and a notch formed in the first plate, wherein the notch is formed by space between a first flange and a second flange, the notch sized to accommodate a ridge of an elevator rail, wherein the ridge of each rail is narrower than a width of the rail, the ridge is located at a lateral center of the width, and the notch being sized such that the notch is narrower than the width of the rail, and sized so that the ridge is positioned between the first flange and the second flange.

14. The support frame of claim 13, further comprising a single rail hitch plate affixed to a subset of vertical corner beams from the plurality of vertical corner beams.

15. The support frame of claim 13, wherein the hoist platform is moveable along the plurality of top rails using a plurality of wheels.

16. The support frame of claim 13, further comprising a plurality of intermediate vertical beams affixed to both the machine frame and a top rail from the plurality of top rails.

17. The support frame of claim 13, wherein each lateral anchor beam from the plurality of lateral anchor beams comprises a plurality of fastener openings therein.

* * * * *